United States Patent [19]

Ferrante

[11] 4,353,487

[45] Oct. 12, 1982

[54] DOSIFYING CONTAINERS FOR GRANULATED PRODUCTS, PULVERULENT PRODUCTS, ETC.

[76] Inventor: Jose Ferrante, Gran Canaria 329, 1868 Quilmes Pcia. de Buenos Aires, Argentina

[21] Appl. No.: 758,502

[22] Filed: Jan. 11, 1977

[30] Foreign Application Priority Data

Jan. 16, 1976 [AR] Argentina ..... 261949

[51] Int. Cl.[3] ..... A47G 19/24; B65D 47/00

[52] U.S. Cl. ..... 222/500; 222/518

[58] Field of Search ..... 222/196.2, 500, 518

[56] References Cited

U.S. PATENT DOCUMENTS

| | | | |
|---|---|---|---|
| 1,470,049 | 10/1923 | Barrows | 222/500 |
| 1,776,395 | 9/1930 | Rundell | 222/196.2 |
| 2,694,512 | 11/1954 | Morris | 222/518 X |
| 2,792,160 | 5/1957 | Jones et al. | 222/518 X |
| 3,229,856 | 1/1966 | Jungmann | 222/500 X |

FOREIGN PATENT DOCUMENTS

| | | | |
|---|---|---|---|
| 343651 | 10/1936 | Italy | 222/500 |

*Primary Examiner*—F. J. Bartuska
*Attorney, Agent, or Firm*—Emory L. Groff, Jr.

[57] ABSTRACT

A receptacle for dosifying granulated, pulverulent or liquid products includes a product containing receptacle and a hollow cover which houses a solid closure member normally spring urged to a closed position. By inverting the receptacle and imparting a shaking motion to it, the solid closure member moves away from its closed position against the tension of the spring to an open position thus permitting measured amounts of the product to be dispensed as continued opening and closing of the closure member occurs relative to the motion imparted to the receptacle by the user. The inner portion of the solid closure member is preferably provided with at least one annular recess which receives the product when the receptacle is inverted and aids in dispensing a given quantity thereof. The retraction of the solid closure member by the spring causes it to forcibly engage the adjacent edge of the hollow cover, thus breaking up any lumps of the product which may be present at the discharge opening.

8 Claims, 14 Drawing Figures

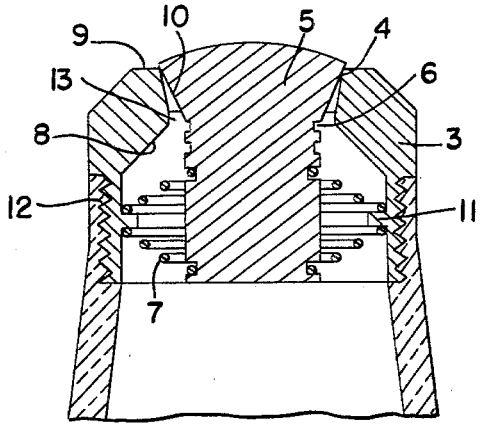
FIG. 14.
FIG. 6.
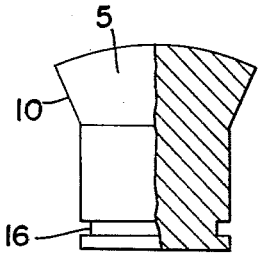
FIG. 7.
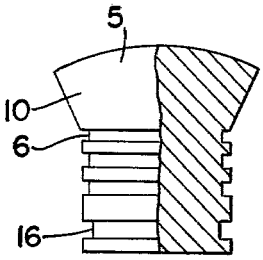
FIG. 8.
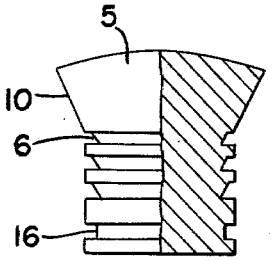
FIG. 9.
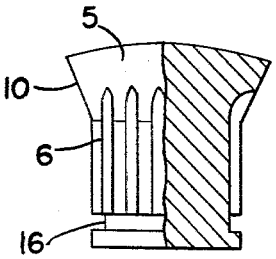
FIG. 10.
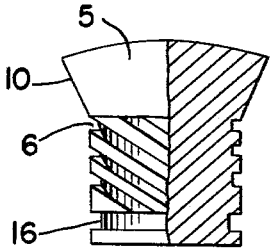
FIG. 11.
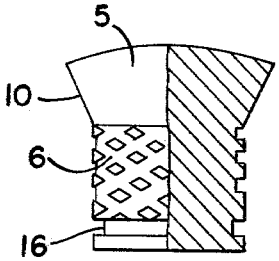
FIG. 12.
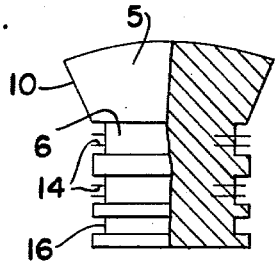
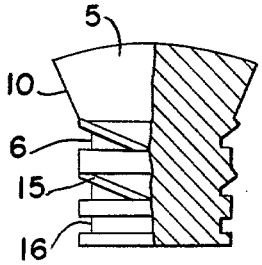
FIG. 13.

DOSIFYING CONTAINERS FOR GRANULATED PRODUCTS, PULVERULENT PRODUCTS, ETC.

The present invention refers to improvements in dosifier receptacles for granulated, pulverulent or liquid products and for any other products which, to be dosified, must be reduced to granular or powder size. The dosifying receptacle according to the invention embodies a new arrangement of components, leading to important advantages in its application and use as will hereinafter be described.

The difficulties encountered with existing types of dosifiers for such products are well known, namely, the clogging of the outlet orifices. These difficulties increase when the products in question are of hygroscopic nature and when part or all of the product becomes agglomerated or lumpy, thus entirely blocking the outlet orifices of said known dosifying receptacles.

It is well known that the ambient atmosphere contains a certain amount of humidity which is absorbed by hygroscopic substances, such as common table salt. Furthermore, when such a product is added to the food, the vapors issuing from the latter contribute still further to dampen the salt, thus rendering it useless inasmuch as it is practically impossible to make damp salt pass through the outlet orifices of the common salt cellars, to such a degree that the damp salt must frequently be discarded and replaced with dry salt.

The object of the present invention is to permit the dosifier to be used satisfactorily regardless of the degree of humidity of the salt. The present invention obviates the necessity of having to clear the orifices or discarding the product when the degree of humidity of same has reached an excessive level.

The dosifier which is the object of the present invention comprises a common or current type product container such as a salt cellar in combination with a novel cap or cover comprising a hollow cylindrical body, which is threaded on to the open end of the receptacle. The hollow cylindrical body concentrically houses a solid cylinder of smaller diameter than the inside of said body. The cylinder is provided at its inner end with a spring which engages the body while at its other end said cylinder terminates in an annular truncated-cone shaped or sperical cap-shaped widened portion, in such a manner that the spring tension normally presses said widened portion against the upper edge of the hollow cylinder, thus producing a sealed closure.

The solid cylinder can be displaced from a closed to an open position by a to-and-fro or shaking movement along its vertical axis when salt is to be dispensed from the receptacle. Each impulse by the user's hand will eject an amount of salt from the receptacle which has accumulated in one or several annular recesses provided for that purpose in the outer surface of the solid cylinder. The cylinder then returns to a closed position in a sudden movement brought about by spring action exerted towards the inside of the receptacle, while the salt, on the contrary, due to its inertia continues on its outward way and for this reason leaves its recess and strikes the annular widened portion or the collecting ring which is the termination of the hollow cylinder. In this manner, controlled dispersion of the salt is assured as well as the breaking up and disintegration of possible clumps that may have formed inside the receptacle.

It is to be pointed out that the amplitude of the to-and-fro motion of the solid cylinder depends upon its weight and the intensity which the hand of the user imparts to the impulse.

From the above it can be seen that the opening through which the salt is to pass is variable and can be widened sufficiently to permit the passage of any grain or clump which normally would be formed due to humidity. The opening and closing of the receptacle is automatic inasmuch as spring tension will keep the annular widened portion of the solid cylinder pressed against the upper edge of the cover when the salt cellar is not being used, and will open automatically when manually activated, in such a manner that each impulse imparted by the user will bring about automatic opening and closing action.

In order to allow the salt to reach the annular recesses which are to be charged in order to convey and/or impel outwardly a portion of the material, a circular crown-shaped gap is provided between the inside diameter of the cover and the outside diameter of the solid cylinder. This gap is sufficiently wide to enable the salt to fall freely towards the annular recesses, the latter being designed to store, convey and expel outwardly a given quantity of salt. In order to provide the desired function, the bottom of said recesses may be cylindrical or conical and axial grooves can be cut into their surface. The grooves may be ring-shaped, helical or a combination of such shapes to form cells which, while moving within the material being dispensed will be able to break up the agglomerations of same and will receive small portions thereof in optimum conditions to be expended.

In order that the present invention may be more clearly understood and readily put into practice, the same will now be described with reference to a preferred embodiment, illustrated by way of example in the attached drawings.

In the drawings:

FIGS. 6 through 13 show different types of grooves which may be provided in the outer surface of the solid cylinder.

FIG. 14 is a fragmentary vertical cross-section showing a modification of the salt cellar in which the resilient element consists of two conical helicoidal springs.

Similar reference characters represent similar parts throughout the several figures of the drawings.

Figure 1:
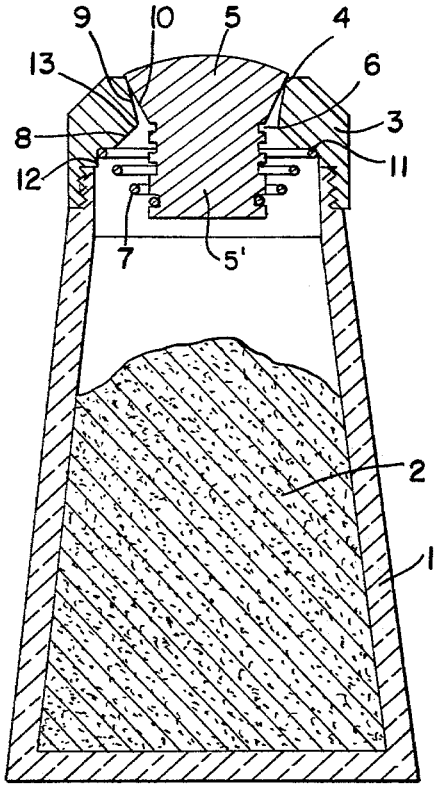
FIG. 1 is a vertical cross-section of a salt cellar provided with the improvements according to the present invention.
Figure 3:
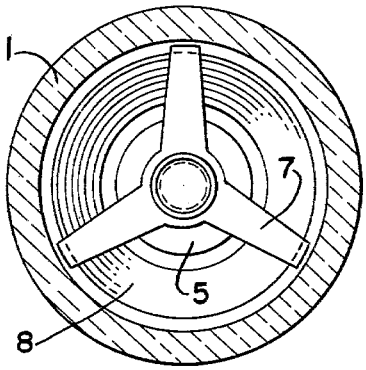
FIG. 3 is a horizontal cross-section taken on the line 3—3 of FIG. 2, showing the spring, which can have two or more radial fins.

In accordance with FIG. 1, the present invention is applied to a table salt cellar, consisting of a receptacle 1 containing the product 2, of a granular or pulverulent nature and closed by the dosifying system.

This dosifying system consists of a cover or cap defined by a hollow cylinder 3 screwed on to the open end of receptacle 1. The hollow cylinder 3 consists interiorly of a cylindrical cavity 12 followed by a reduced diameter portion providing a shoulder 11 seating one end of a spring 7 and continuing in a truncated-cone shaped or concave cavity 8, followed by a cylindrical throat 13 and a truncated-cone or concave-shaped cavity 9 terminating in the upper edge 4 which is the intersection of the cavity 9 with the outside surface of the hollow cylindrical cap 3. A solid cylindrical plug or closure 5 is disposed concentrically within the hollow cylinder 3 and is aligned with the lengthwise axis of the container. The plug 5 seats against upper edge 4, and at this supporting end has the shape of a truncated-cone or spherical cap 10 to permit total support of its surface when the dosifier is not being used and thus providing a hermetic seal for the receptacle.

The above described portion of the solid plug 5 is followed by a cylindrical lower body 5' having an outer periphery 5''. According to one of the modifications, this surface can be smooth but preferably it can be provided with annular recesses 6 which, when moving within the material, become charged with small portions of same. These portions are thus conveyed and/or driven with sufficient movement to cause them to be expelled out of the receptacle, to be thus dosified when the user imparts a shaking motion to the salt cellar.

The aforementioned annular recesses can be cylindrical annular grooves (FIG. 7), conic annular grooves (FIG. 8), axial grooves (FIG. 9), helical grooves (FIG. 10), oppositely directed helical grooves (FIG. 11) or any combinations of the same. Radially or outwardly projecting stiff or resilient hairs or blades 14 can be inserted into any of these types of grooves as shown in FIG. 12 as well as fitted into the outer surface of the non-grooved cylinder.

Helical ribs 15 (FIG. 13) can be provided on the cylindrical portion of the solid cylinder 5 or within the annular recesses 6, their purpose being to guide the displacement of the cylinder 5 within the cylindrical throat 13, especially when said cylinder 5 is provided with annular grooves in the outside surface thereof.

The solid plug 5 at its lower end is provided with a groove 16 into which may be inserted the end of a spring 7 joining the plug with the hollow cylindrical cap 3. The specific weight of the solid plug, which may be made of a metal such as iron or steel, must be high in order to be able to accumulate sufficient energy to deform spring 7. It is to be pointed out that the entire solid plug may be of metal, or only its inner part may be metallic. Said spring 7 may be helically cylindrical, helically conical, as has been illustrated in FIG. 1, or may consist of resilient leaves, in any number and in the shape of radial fins. In FIG. 14 there is shown two conical helicoidal springs which act on the solid plug 5.

Figure 2:
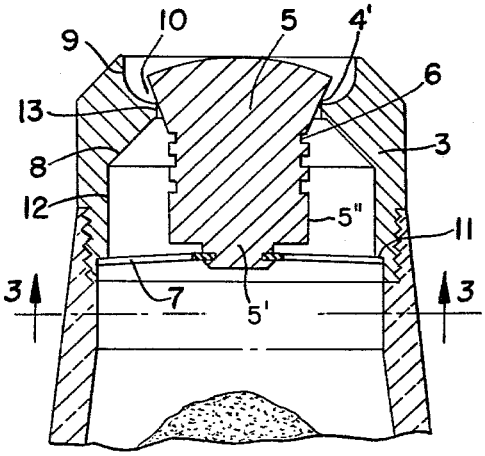
FIG. 2 is an enlarged fragmentary vertical cross-section of a modification of the cover of the salt cellar shown in FIG. 1.

FIG. 2 shows a modification in which the closure takes place on the edge 4' intersecting cylindrical cavity 13 and truncated-cone or spherical cap-shaped cavity 9, which is located outside of the receptacle and acts as a collector limiting the amplitude of the crown and at the same time serving to break up the material.

Operation and use of the present improved dosifier are most simple, as will be seen from the following description:

Once the product 2 has been placed in the receptacle 1 the dosifier system comprising basically the hollow cylinder 3, solid plug 5 and spring 7, is attached to the receptacle by means of a threaded connection. Optionally, however, any other connecting means may be used to join the dosifier to the receptacle 1 in a secure manner.

Figure 4:
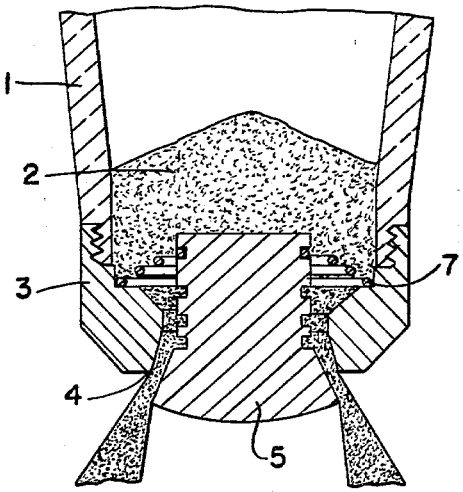
FIG. 4 is a fragmentary cross-section showing a salt cellar in an inverted position after a downward movement has been imparted to it causing the solid cylinder to move into an open position permitting salt to be dispensed therefrom.
Figure 5:
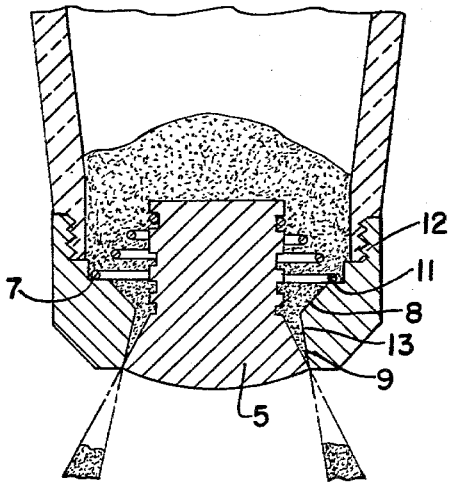
FIG. 5 is a fragmentary cross-section showing the salt cellar of FIG. 4 with the solid cylinder in its closed or retracted position after a measured amount of salt has been dispensed from the container.

To operate the salt cellar, it is inverted as is usual, with the exposed face of the dosifier opposite the surface to be dosified with the product. When the dosifier is inverted, the material descends to occupy the entire space between the hollow cylindrical cap plug 3 and solid 5, as shown in FIGS. 4 and 5. The receptacle is then shaken in a rough to-and-fro movement, along its longitudinal axis. Due to inertia, the solid plug 5 will be displaced to a degree of magnitude directly related to the intensity of the shaking movement, then returning to a closed position with a sudden movement due to action by spring 7. The salt contained in annular recesses 6 will then, due to inertia, leave the recesses and, in continuing its trajectory, will be able to pass without interfering with the surface 10 at the end of the solid plug 5 or with the truncated cone of spherical cap-shaped cavity 9. If any large particles or lumps of salt or other material becomes wedged between the surface 10 and the edge 4 of cap 3, they will be broken up as the plug 5 is retracted to its seated or closed position by spring 7.

Both in the description of the dosifier as well as its function and use, the material to be dosified has been considered to be finely granulated kitchen salt. This has been done for illustrative purposes and not by way of limitation, inasmuch as the present improved dosifier is useful for dosifying other products such as, for example, ground pepper, grain pepper, red pepper, marjoram, cinnamon, ground capsicum, sugar, grated cheese, grated coconut, anise seeds, confections, coarse salt and any other granular or powdered product.

It is evident that various modifications as to construction and details may be made without thereby departing from the spirit and scope of the present invention.

I claim:

1. A container for dispensing granular or powdery products including a receptacle for containing the product, a cap having a bottom portion assembled on said receptacle and having a top portion provided with an aperture for the egress of the product, said cap aperture including a circular periphery having a reduced diameter portion disposed axially inwardly from the outer endmost portion of said cap aperture periphery, a plug disposed within said aperture and having an uppermost enlarged portion sealingly engageable with said periphery of said cap aperture at a point outwardly beyond the innermost portion of said reduced diameter portion, said plug including a lower body extending downwardly from said uppermost enlarged portion into the interior of said container, said plug lower body having an axially extending cylindrical periphery provided with a diameter less than the diameter of the adjacent said plug uppermost enlarged portion and of said cap aperture reduced diameter portion, a spring having one end secured to said plug lower body, said spring radially extending from said plug lower body and having its other end secured relative the inner wall of said container, said plug lower body cylindrical periphery provided with a plurality of shallow grooves thereon, said grooves angularly offset relative the vertical longitudinal axis of said plug to provide grooves running other than parallel to said plug longitudinal axis, said spring normally biasing said plug uppermost enlarged portion downwardly into sealing engagement with said aperture, said grooves on said plug lower body displaceable upon axial reciprocation of said container to axially displace said plug against the force of said spring and project at least a portion of said grooves through said cap aperture whereby, upon inversion of said container the product gravitates to the juncture of said plug and cap and sudden axial reciprocation of said container alternately displaces said plug against and with the force of said spring to reciprocate said plug lower body axially of said cap aperture as said grooves thereon engage, capture and propel the product from the interior of said container through said cap aperture.

2. A container according to claim 1 including, a plurality of radially extending elements projecting from said cylindrical lower body for entraining the granular or powdery product.

3. A container according to claim 2 wherein, said projecting elements are stiff.

4. A container according to claim 2 wherein, said projecting elements are resilient.

5. A container according to claim 2 wherein, said projecting elements have a length equal to the depth of said grooves and their free ends are out of contact with respect to said aperture.

6. A container according to claim 2 wherein, said lower cylindrical body of said plug having said plurality of shallow grooves further includes helicoidal ribs thereon capable of guiding said plug to preclude interference of said blades or hairs with the edge of said aperture during reciprocation of said plug.

7. A container for dispensing granular or powdery products including a receptacle for containing the product, a cap having a bottom portion assembled on said receptacle and having a top portion provided with an aperture for the egress of the product, said cap aperture including a circular periphery having a reduced diameter portion disposed axially inwardly from the outer endmost portion of said cap aperture periphery, a plug disposed within said aperture and having an uppermost enlarged portion sealingly engageable with said periphery of said cap aperture, at a point outwardly beyond the innermost portion of said reduced diameter portion, said plug including a lower body extending downwardly from said uppermost enlarged portion into the interior of said container, said plug lower body having an axially extending cylindrical periphery provided with a diameter less than the diameter of the adjacent said plug uppermost enlarged portion and of said cap aperture reduced diameter portion, a spring having one end secured to said plug lower body, said spring radially extending from said plug lower body and having its other end secured relative the inner wall of said container, said plug lower body cylindrical periphery provided with a plurality of shallow grooves thereon, said grooves angularly offset relative the vertical longitudinal axis of said plug to provide grooves running other than parallel to said plug longitudinal axis, a plurality of radially extending elements projecting from said cylindrical lower body for entraining the granular or powdery product, said projecting elements disposed inside said grooves whereby small cells are formed inside said grooves, said spring normally biasing said plug uppermost enlarged portion downwardly into sealing engagement with said aperture, said grooves on said plug lower body displaceable upon axial reciprocation of said container to axially displace said plug against the force of said spring and project at least a portion of said grooves through said cap aperture whereby, upon inversion of said container the product gravitates to the juncture of said plug and cap and sudden axial reciprocation of said container alternately displaces said plug against and with the force of said spring to reciprocate said plug lower body axially of said cap aperture as said grooves thereon engage, capture and propel the product from the interior of said container through said cap aperture.

8. A container for dispensing granular or powdery products including a receptacle for containing the product, a cap having a bottom portion assembled on said receptacle and having a top portion provided with an aperture for the egress of the product, said cap aperture including a circular periphery having a reduced diameter portion disposed axially inwardly from the outer endmost portion of said cap aperture periphery, a plug disposed within said aperture and having an uppermost enlarged portion sealingly engageable with said periphery of said cap aperture at a point outwardly beyond the innermost portion of said reduced diameter portion, said plug including a lower body extending downwardly from said uppermost enlarged portion into the interior of said container, said plug lower body having an axially extending cylindrical periphery provided with a diameter less than the diameter of the adjacent said plug uppermost enlarged portion and of said cap aperture reduced diameter portion, a spring having one end secured to said plug lower body, said spring radially extending from said plug lower body and having its other end secured relative the inner wall of said container, said plug lower body cylindrical periphery provided with a plurality of shallow grooves thereon, said grooves angularly offset relative the vertical longitudinal axis of said plug to provide grooves running other than parallel to said plug longitudinal axis, said lower cylindrical body of said plug having said plurality of shallow grooves further included helicoidal ribs thereon capable of guiding said plug to preclude interference of said grooves with the edge of said aperture during reciprocation of said plug, said spring normally biasing said plug uppermost enlarged portion downwardly into sealing engagement with said aperture, said grooves on said plug lower body displaceable upon axial reciprocation of said container to axially displace said plug against the force of said spring and project at least a portion of said grooves through said cap aperture whereby, upon inversion of said container the product gravitates to the juncture of said plug and cap and sudden axial reciprocation of said container alternately displaces said plug against and with the force of said spring to reciprocate said plug lower body axially of said cap aperture as said grooves thereon engage, capture and propel the product from the interior of said container through said cap aperture.

* * * * *